US008628142B2

(12) United States Patent
van Hekken

(10) Patent No.: US 8,628,142 B2
(45) Date of Patent: Jan. 14, 2014

(54) CHAIR HAVING MOVEABLE TABLET

(75) Inventor: Hendrik R. van Hekken, Allentown, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 13/478,565

(22) Filed: May 23, 2012

(65) Prior Publication Data

US 2012/0306240 A1 Dec. 6, 2012

Related U.S. Application Data

(60) Provisional application No. 61/493,179, filed on Jun. 3, 2011.

(51) Int. Cl.
*A47B 39/00* (2006.01)
*A47B 83/02* (2006.01)

(52) U.S. Cl.
USPC ..... 297/160; 297/161; 297/162; 297/173

(58) Field of Classification Search
USPC ..... 297/155, 160, 161, 162, 173, 463.1, 297/463.2; 16/342, 273
See application file for complete search history.

(56) References Cited

U.S. PATENT DOCUMENTS

| | | | | |
|---|---|---|---|---|
| 406,902 | A * | 7/1889 | Allen | 122/251 |
| 955,523 | A | 4/1910 | Lytle | |
| 1,691,053 | A | 11/1928 | Ferris | |
| 1,757,322 | A | 5/1930 | Maxwell | |
| 2,675,062 | A | 4/1954 | Clarin | |
| 2,954,073 | A | 9/1960 | Junkunc | |
| 3,156,498 | A | 11/1964 | Blodee | |
| 3,194,600 | A | 7/1965 | Junkunc | |
| 3,197,254 | A | 7/1965 | Hendrickson | |
| 3,216,764 | A | 11/1965 | Junkunc | |
| 3,261,641 | A | 7/1966 | Black et al. | |

(Continued)

FOREIGN PATENT DOCUMENTS

| | | | |
|---|---|---|---|
| GB | 406902 | A | 3/1934 |
| JP | 53045910 | U | 4/1978 |

OTHER PUBLICATIONS

International Search Report for PCT/US2012/039238 dated Aug. 22, 2012.

(Continued)

*Primary Examiner* — David Dunn
*Assistant Examiner* — Richard Lowry
(74) *Attorney, Agent, or Firm* — Buchanan Ingersoll & Rooney PC

(57) ABSTRACT

A chair includes a base, a seat supported on the base, and a support member having an upper portion and at least one lower portion that is lower than the upper portion. The at least one lower portion of the support member is attached to at least one of the base and the seat. The upper portion of the at least one support member is attached to the at least one lower portion. A portion of the upper portion defines an offset positioned inwardly toward the seat relative to other sections of the upper portion. A tablet is moveably attached to the upper portion such that it is moveable from a first position to a second position. The offset is positioned so it supports the tablet when the tablet is in the second position and transfers a substantial amount of load supported by the offset to the support member.

30 Claims, 5 Drawing Sheets

(56) References Cited

U.S. PATENT DOCUMENTS

| | | | | | |
|---|---|---|---|---|---|
| 3,368,842 | A | * | 2/1968 | Polsky | 297/162 |
| 3,371,956 | A | | 3/1968 | Jordan et al. | |
| 3,556,588 | A | | 1/1971 | Monyer et al. | |
| 3,567,276 | A | | 3/1971 | Van Ryn | |
| 3,847,432 | A | * | 11/1974 | Jennings | 297/160 |
| 3,982,785 | A | * | 9/1976 | Ambasz | 297/160 |
| 4,159,846 | A | * | 7/1979 | Tolleson | 297/162 |
| D280,681 | S | | 9/1985 | Rowland | |
| 4,568,948 | A | * | 2/1986 | Moriguchi et al. | 347/181 |
| 4,848,833 | A | | 7/1989 | Grall | |
| 5,845,964 | A | | 12/1998 | Phoon | |
| 5,924,770 | A | * | 7/1999 | Tarnay et al. | 297/440.15 |
| 6,375,257 | B1 | * | 4/2002 | Wooding et al. | 297/162 |
| 6,837,539 | B1 | * | 1/2005 | Casey | 297/162 |
| 7,017,988 | B2 | * | 3/2006 | Tornero et al. | 297/145 |
| 7,695,061 | B2 | | 4/2010 | Olarte | |
| 2003/0090139 | A1 | | 5/2003 | Kown | |
| 2008/0203778 | A1 | * | 8/2008 | Weber et al. | 297/162 |
| 2009/0038119 | A1 | * | 2/2009 | Rude et al. | 16/342 |

OTHER PUBLICATIONS

Written Opinion of International Searching Authority for PCT/US2012/039238 dated Aug. 22, 2012.

* cited by examiner

CHAIR HAVING MOVEABLE TABLET

CROSS-REFERENCE TO RELATED APPLICATIONS

The present application claims priority to U.S. Provisional Patent Application No. 61/493,179, which was filed on Jun. 3, 2011.

FIELD OF INVENTION

The present invention relates to chairs, such as chairs that have tablet arms that are moveable from a lowered position to a raised position.

BACKGROUND OF THE INVENTION

Chairs that have tablets typically include a seat that is supported on a base. The base may include a plurality of chair legs. The chair also typically includes an arm that has a tablet attached thereto. The tablet is sized and configured to permit a user, such as a student, to sit in and get out of the seat while also providing the user with a work surface. For instance, a laptop, books, or papers may be placed on the work surface of the tablet or the user may write on paper supported by the work surface. Examples of tablet armed chairs may be appreciated from U.S. Pat. Nos. 955,523, 1,691,053, 1,757,322, 2,675,062, 2,954,073, 3,156,498, 3,194,600, 3,197,254, 3,216,764 3,261,641, 3,371,956 3,556,588, 3,567,276, 3,847,432, 4,848,833, D280,681, 5,845,964, 6,375,257, and 7,695,061.

Some designs of tablet arm chairs permit the tablet to be moved. Designs for such chairs typically require a fastener, such as at least one screw or bolt that passes through a bracket, to be used to attach the tablet to a support for the tablet to be moveable. The fastener typically must withstand substantial force from the user when the tablet is in use and when the tablet is moved. As a result of such force, the fastener often must be designed to withstand the forces it will experience when the tablet is used. Such a design often adds substantial cost to the manufacture of the chair. This is particularly true if the chair design requires a complex joint or bracket system that is configured to permit the tablet to be raised and lowered such as the fastening mechanisms disclosed in U.S. Pat. No. 5,845,964, 6,375,257 or 7,695,061 because such mechanisms can be expensive to buy or manufacture.

A new design is needed for chairs that have a tablet arm. Such a chair is preferably designed to permit the chair to be manufactured at a lower cost than other chair designs while also permitting the tablet arm to be moveable from a raised position, which may permit a user to more easily sit in the chair, to a lowered position so that the user can make use of the tablet arm after the user is sitting in the chair. For instance, a user may move the tablet to the lowered position to support paper for writing, support a book for reading, or support a laptop or other mobile computer device.

SUMMARY OF THE INVENTION

A chair is provided that has a seat, a base and a tablet that is moveable from a raised position to a lowered position. The seat is supported by the base. The tablet may be attached to the base via at least one support member. The support member may include an upper portion that is comprised of a first section, a second section, and a third section between the first and second sections. The third section may define an offset that is positioned inwardly toward the seat relative to the first and second sections and be configured to engage a middle portion of the tablet when the tablet is in a lowered position to support the tablet. By engaging the portion of the tablet, the third section of the support permits the support to transfer a substantial portion of the load the tablet supports to the support and base of the chair so that the attachment mechanism used to moveably connect the tablet to the support only has to withstand a relatively small portion of this load. The offset defined by the third section of the upper portion is preferably responsible for transference of 50-70% of the load.

In some embodiments, the seat may also be attached to a chair back. For instance, the seat may be attached to the back so that the back and seat are integrally attached. For example, the back and seat may be integrally molded together or may be welded together. In alternative embodiments, the back may be attached to the base of the chair or to both the seat and the base of the chair. In yet other alternatives, the chair may not include a chair back.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of the chair are shown in the accompanying drawings and certain present preferred methods of practicing the same are also illustrated therein.

DETAILED DESCRIPTION OF PRESENT PREFERRED EMBODIMENTS

Figure 1:
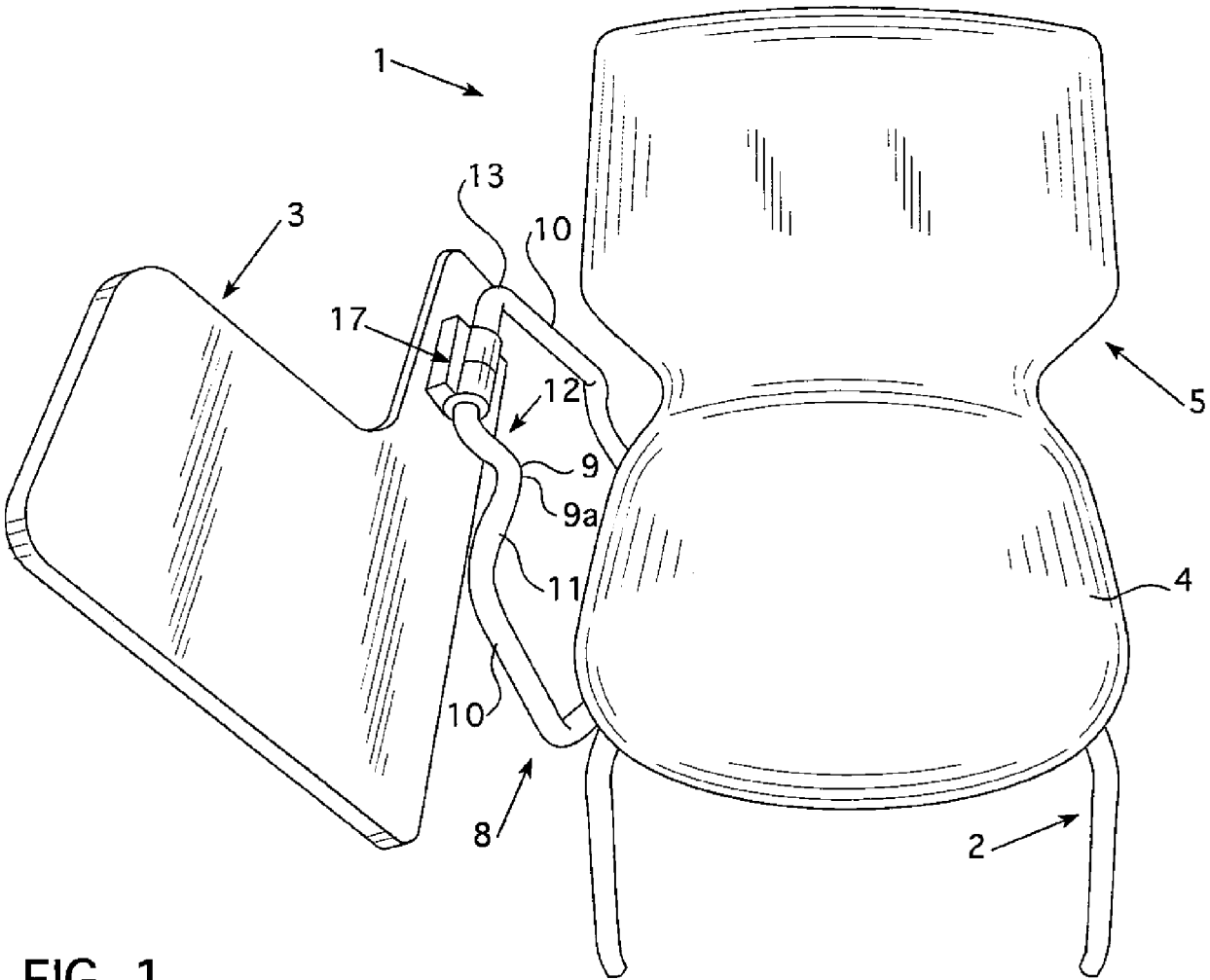
FIG. 1 is a perspective view of a first present preferred embodiment of a chair with the tablet in a first position.

Referring to FIGS. 1-7, a chair 1 includes a base 2 that is comprised of a plurality of legs. The legs may be configured to engage a floor or other surface or may be attached to castors 35 or wheels to permit the chair to be more easily slid or moved along a floor. The base 2 may support a seat 4 and a back 5. For instance, the seat and back may be portions of a seat shell attached to the base. In some embodiments, the seat may be moveably attached to the base 2 such that the seat is moveable relative to the base. In alternative embodiments, the back and seat may each be attached to the base or the seat may be attached to the base and the back may be attached to the seat so that the base supports the seat 4 and back 5.

The chair 1 also includes a support member 8 that is attached to the base 2. The support member 8 may also be attached to the seat 4. The support member may be a tubular structure or other structure that extend from the base 2 or seat 4 to support a tablet 3. The support member 8 may have lower portions, such as vertically extending members 10 that are attached to opposite ends of an upper portion 12 and are also attached to the base 2 or seat 4. The upper portion 12 of the support member 8 may include a first section 11, a second section 13 and a third section 9 that is between the first and second sections 11 and 13. The third section 9 may define a curved offset that is positioned more inwardly toward and above the seat 4 than the first section 11 and second section 13. In other embodiments, the offset may be positioned so that it is more inward of only the second section 13.

The support member 8 may be a unitary structure that is formed of metal, such as steel or aluminum. The upper portion 12 may include sections that are integrally attached by being molded or cast as portions of a unitary structure that are formed along with the lower portions 10 of the support member 8. For example, the support member 8 may be formed as an integral piece of metal, such as steel or stainless steel that is generally circular or annular in cross section and is formed to have a shape similar to the shape shown in FIG. 1. Alternatively, the support member 8 may be formed by fasteners or other connectors attaching different segments of the support member 8 together. Preferably, the offset 9*a* is defined by a segment of the third section 9 of the upper portion 12 of the support member. The third section 9 may be a section that extends inwardly toward the seat 4 from the second section 13. After the offset 9*a*, the third section 9 may extend outwardly toward the first section 11. Preferably, the offset 9*a* is a curved portion of the third section 12.

It should be understood that the vertically extending members 10 of the lower portions of the support member 8 and the upper portion 12 of the support member 8 may be segments of a unitary tubular or cylindrical shaped structure or may be discrete shafts, beams, rods, tubes, pipes or other structural members that are attached together via multiple connectors or fasteners to form the support member 8.

The support member 8 is attached to a tablet 3 via an attachment mechanism 17. The tablet 3 is sized and configured to rotate about the upper portion 12 of the support member 8. Preferably, the attachment mechanism 17 is attached between the second section 13 and offset 9*a* defined by the third section 9.

Figure 2:
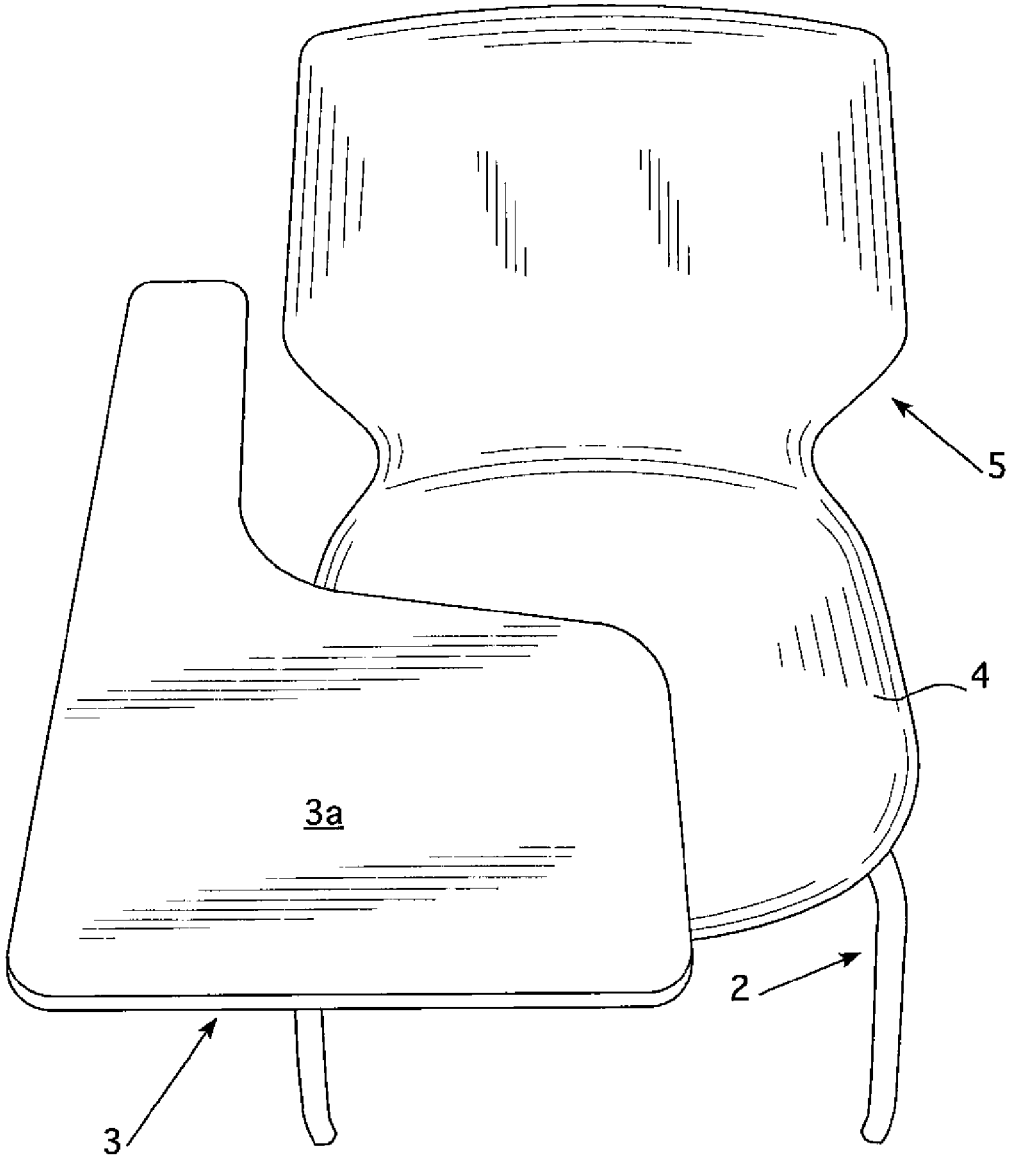
FIG. 2 is a perspective view of the first present preferred embodiment of the chair with the tablet in a second position.
Figure 3:
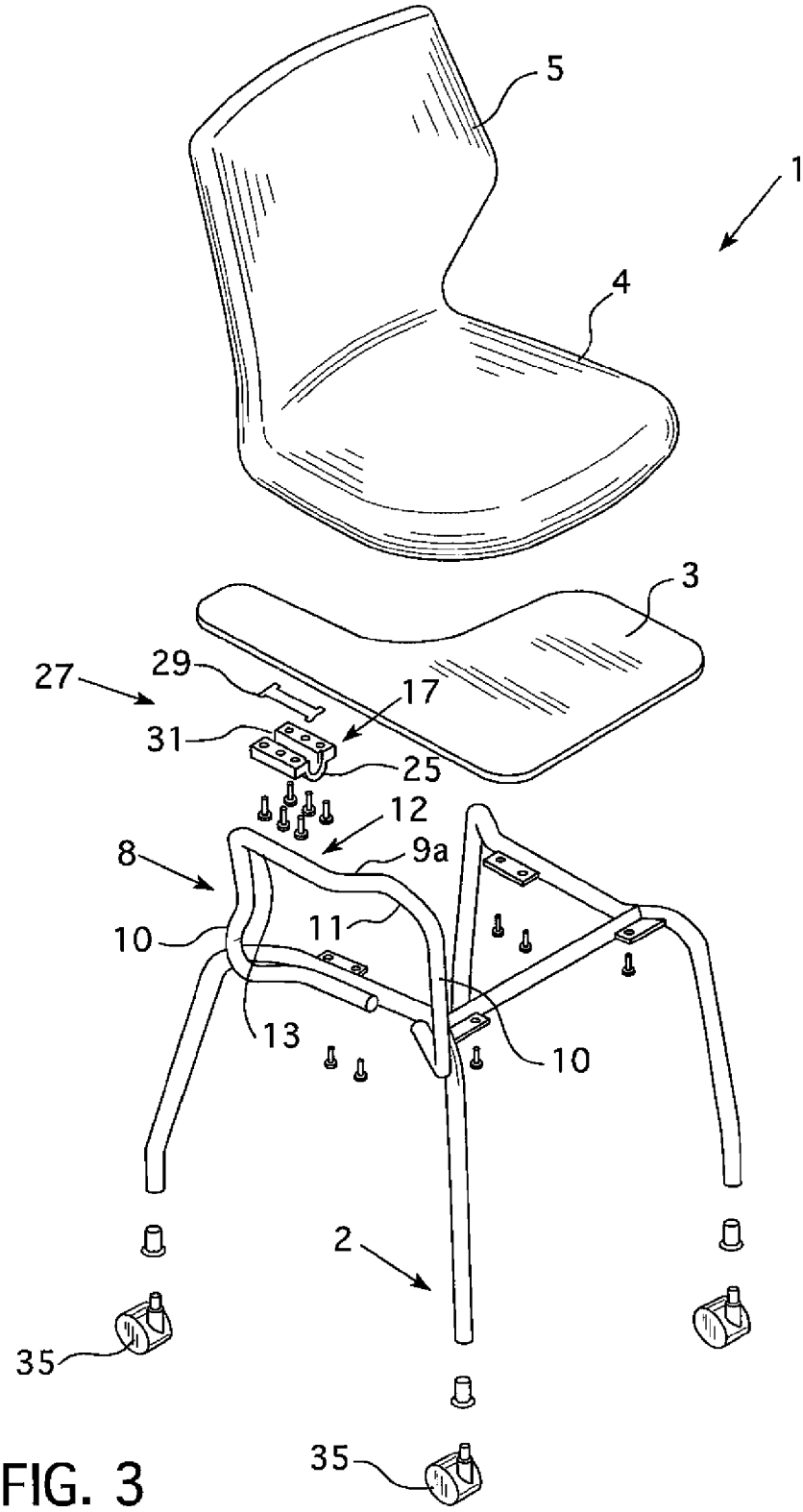
FIG. 3 is an exploded view of the first present preferred embodiment of the chair.
Figure 4:
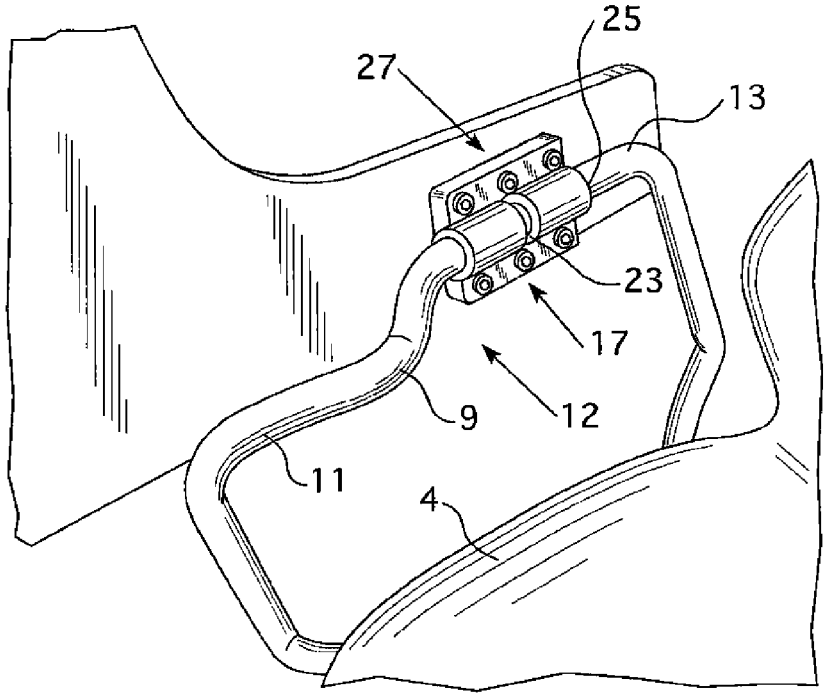
FIG. 4 is a fragmentary view of the first present preferred embodiment of the chair illustrating an attachment mechanism for attaching the tablet to a support of the chair.
Figure 5:
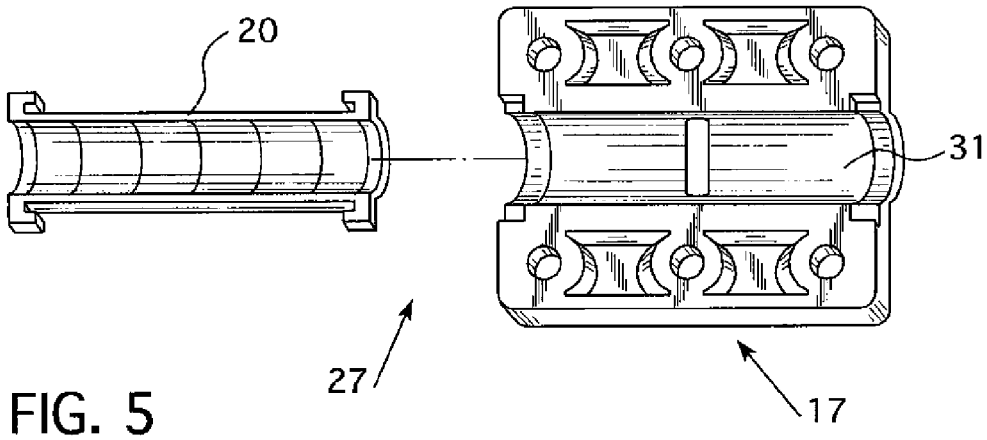
FIG. 5 is an exploded view of a tablet attachment portion and support member attachment portion of a present preferred attachment mechanism that may be used in embodiments of the chair.
Figure 6:
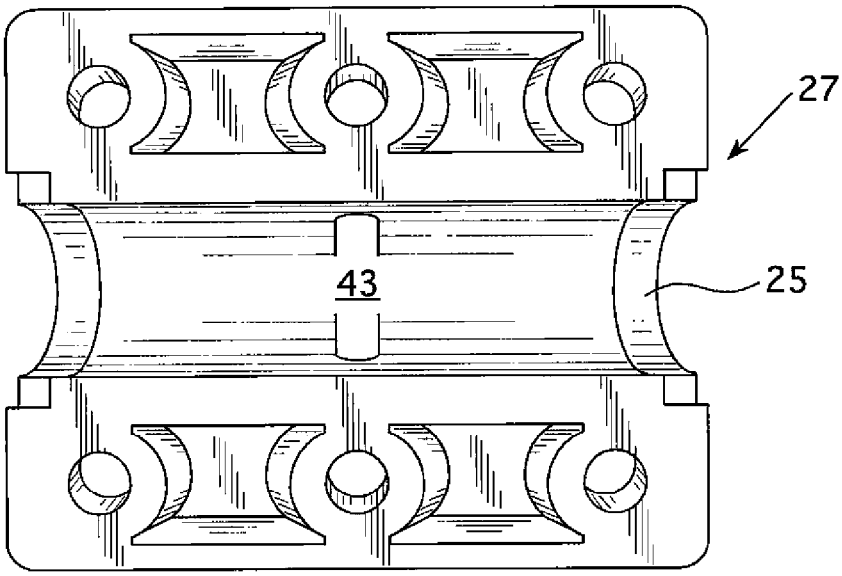
FIG. 6 is an enlarged view of the tablet attachment portion of a present preferred attachment mechanism that may be used in embodiments of the chair.
Figure 7:
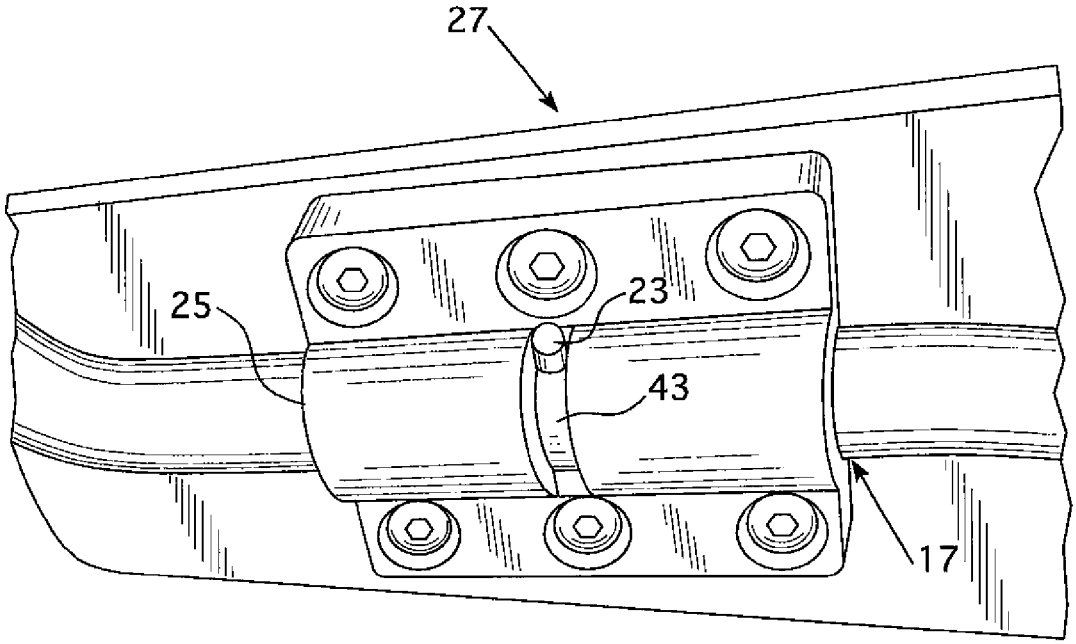
FIG. 7 is a fragmentary bottom view of the attachment mechanism of the first present preferred embodiment of the chair.

As may be appreciated from FIGS. 1-2, the tablet 3 is moveable from a first position, or a raised position, to a second position, or a lowered position. When in the raised position, the tablet 3 is positioned so that a user may easily access the seat 4 of the chair to sit in the chair. When in the lowered position, a seated user may move the tablet 3 so that it defines a substantially horizontal work surface 3*a* that permits a user to place a book or laptop on the tablet to do work or participate in a class or to write on the work surface 3*a* of the tablet 3. When the tablet 3 is in the lowered position, a middle portion of the tablet may engage the offset 9*a* of the upper portion 12 of the support member 8. Preferably, the offset 9*a* is slightly higher than the first and second sections 11 and 13 so that the offset 9*a* is the first portion of the support member 8 that engages the bottom surface of the tablet arm when the tablet arm is rotated from the raised position to the lowered position.

The attachment mechanism 17 may include a bracket assembly. The bracket assembly may include bracket that has a tablet attachment portion 27. The tablet attachment portion 27 includes a body 25 that defines a channel 31 that is sized and configured to receive a segment of the upper portion 12 of the support member 8. A cap 29 is attached to the body 25 such that the cap 29 is positioned over the segment of the upper portion 12 within the channel 31 to cover this segment. The body 25 may have an inner surface that defines the channel. The cap 29 may also have an inner surface. The inner surface of the cap 29 may include crushable ribs that may engage the segment of the support member 8 received within the channel 31 to ensure a tight interference engagement with the received segment and also permit variance to account for slight dimensional changes that may occur due to a tolerance range for acceptable manufactured components of the chair, such as a diameter of the channel 31 or diameter or thickness of the upper portion 12 of the support member. Example of crushable ribs may be deformable protuberances or deformable projections that extend from the inner surface of the cap.

The attachment mechanism 17 may also include a projection 23 that is sized to fit through a slot 43 formed in the body 25 of the tablet attachment portion 27 of the attachment mechanism 17, which defines the channel 31. The body 25 may alternatively be configured as a section of a bracket portion of the attachment mechanism 17. The projection 23 may be a rod, bar, pin or other structure that is welded to the upper portion 12 of the support member 8 to extend through slot 43 in the body 25 of the attachment portion 27. The projection 23 does not move, but the attachment mechanism 17 is permitted to rotate about the upper portion 12 of the support member 8 relative to the projection 23 via the slot 43 to define a path of travel for the tablet 3. The projection 23 engages the ends of the slot 43 to define the path of movement for the tablet 3 so that the raised and lowered positions of the tablet 3 are defined by the slot 43 and projection 23.

The attachment mechanism 17 may also include holes in the tablet attachment portion 27 of the bracket. The holes may receive screws, bolts, or other fasteners for attaching the tablet 3 to the tablet attachment portion 27. Preferably, the body 25 and cap 29 are comprised of nylon that is 50% glass filled and the projection 23 is preferably a cylindrical piece of stainless steel, aluminum, or steel that is welded to the upper portion 12 of the support member 8.

The offset 9*a* may be a curved portion of the upper portion 12 of the support member that is positioned to be slightly higher than the first and second sections 11 and 13 of the upper portion 12 so that the offset 9*a* is the first portion of the upper portion of the support member that engages the bottom surface of the tablet 3 when the tablet is moved to the lower position. The difference in elevation between the offset 9*a* and the first and second sections 11 and 13 may be, for example, 0.0625 inches (1/16 of an inch), 0.03125 inches (1/32 of an inch) or less in distance. The offset permits the upper portion 12 of the support member 8 to transfer a substantial portion of the load of the tablet to the support member 8 and chair base 2 when the tablet is moved to the lowered position. The offset 9*a* defined by the third section of the upper portion 12 is preferably responsible for transference of 50-70% of the load. In some embodiments, the offset 9*a* may transfer as much as 85% to 90% of the load to the support member 8 and base 2 of the chair.

Because the offset 9*a* of the upper portion 12 of the support member 8 directly engages the bottom of the tablet 3 when the tablet 3 is lowered into its lowered position, the projection 23 can be sized to be relatively small and the attachment mechanism 17 may be of a relatively simple construction. It should be appreciated that the projection 23 can be made smaller because it may transfer a much smaller percent of the load as compared to conventional designs. For instance, the projection 23 may only have to transfer ten percent to fifteen percent of the load when the tablet 3 is in its lowered position due to the offset 9*a* engaging the tablet 3 and transferring a substantial amount of the load to the other portions of the support member 8 and base 2 in some embodiments of the chair 1. As a result, the construction of embodiments of the chair 1 may be much lower than costs associated with designs of tablet chairs that have moveable joints utilized for moving and supporting the tablet.

It should be understood that variations of the present preferred embodiments of the chair discussed above may be made. For example, a number of different arrangements of seat and chair backs may be used for different chair designs. As another example, the chair base may be designed to utilize a pedestal base that includes a gas spring or other height adjustment mechanism and castors to permit the base to be easily moved by a seated user. As yet another example, the chair back may be configured to move from an upright to a reclined position or may be configured to be affixed to the seat or base of the chair so that the back does not move relative to the seat or base. As yet another example, the seat may be configured to move synchronously with any back recline movement or may be configured to move independent of the back or may be configured to be affixed to the base so that the seat is not moveable relative to the base.

While certain present preferred embodiments of the chair and methods of making such a chair have been shown and described above, it is to be distinctly understood that the invention is not limited thereto but may be otherwise variously embodied and practiced as may be appreciated by those skilled in the art.

What is claimed is:

1. A chair comprising:

a base, a seat supported on the base;

a support member having an upper portion and at least one lower portion that is lower than the upper portion, the at least one lower portion attached to at least one of the base and the seat, the upper portion attached to the at least one lower portion, the upper portion having a first section, a second section, and a third section between the first and second sections, the third section defining an offset positioned inwardly toward the seat relative to at least one of the first section and the second section;

a tablet moveably attached to the upper portion of the support member such that the tablet is moveable from a first position to a second position;

wherein the offset is positioned such that the offset engages the tablet when the tablet is in the second position and transfers a substantial amount of load supported by the offset to the support member when the tablet is in the second position; and an attachment mechanism, the attachment mechanism moveably attaching the tablet to the upper portion of the support member such that the tablet is moveable from the first position to the second position, the attachment mechanism comprising a bracket assembly that defines a channel that receives a portion of the upper portion and a projection that is attached to the upper portion that extends through a slot formed in the bracket assembly, the projection of the attachment mechanism and the slot of the bracket assembly defining a path of movement of the tablet between the first and second positions;

wherein the bracket assembly is comprised of a tablet attachment portion that defines the channel that receives the portion of the upper portion of the support member and wherein the slot is formed in the tablet attachment portion of the bracket assembly; and a cap attached to the tablet attachment portion adjacent the channel and above the portion of the upper portion of the support member received within the channel; and wherein the cap has crushable ribs formed on an inner surface of the cap such that the crushable ribs engage the upper portion received in the channel; and wherein the offset is positioned so that a portion of the offset is at a location that is higher than the first section of the upper portion of the support member and is also higher than the second section of the upper portion of the support member.

2. The chair of claim 1 wherein the projection is attached to the upper portion of the support member via welding or an integral attachment fastening mechanism.

3. The chair of claim 1 wherein the projection only supports 10-15% of the load and the rest of the load is transferred to at least one of the support member and the base via the offset when the tablet is in the second position.

4. The chair of claim 1 wherein the bracket assembly is comprised of nylon that is 50% glass filled, a polymeric material, or a plastic and wherein the projection is comprised of a metal.

5. The chair of claim 1 wherein the portion of the offset that is at the location that is higher than the first and second sections of the upper portion is a curved portion of the third section.

6. The chair of claim 1 wherein the base is comprised of a pedestal or a plurality of legs attached to the seat.

7. The chair of claim 1 further comprising a back attached to at least one of the seat and the base.

8. The chair of claim 1 wherein the seat is comprised of a polymeric material.

9. The chair of claim 1 wherein the seat is affixed to the base.

10. The chair of claim 1 wherein the seat is moveable relative to the base.

11. The chair of claim 1 wherein the tablet is moveable such that the tablet rotates about the upper portion of the support member to move from the first position to the second position and wherein the projection does not move when the tablet is rotated.

12. The chair of claim 1 wherein the substantial amount of load that is transferred via the offset is over 50% of the load.

13. The chair of claim 1 wherein the substantial amount of load that is transferred via the offset is between 50% and 70% of the load.

14. The chair of claim 1 wherein the projection only supports 10% to 15% of the load and wherein the other 85% to 90% of the load is transferred to at least one of the support member and the base via the offset.

15. A chair comprising:

a base, a seat supported on the base;

a support member having an upper portion and at least one lower portion that is lower than the upper portion, the at least one lower portion attached to at least one of the base and the seat, the upper portion attached to the at least one lower portion, the upper portion having a first section, a second section, and a third section between the first and second sections, the third section defining an offset positioned inwardly toward the seat relative to at least one of the first section and the second section;

a tablet moveably attached to the upper portion of the support member such that the tablet is moveable from a first position to a second position;

wherein the offset is positioned such that the offset engages the tablet when the tablet is in the second position and transfers a substantial amount of load supported by the offset to the support member when the tablet is in the second position; and an attachment mechanism, the attachment mechanism moveably attaching the tablet to the upper portion of the support member such that the tablet is moveable from the first position to the second position, the attachment mechanism comprising a bracket assembly that defines a channel that receives a portion of the upper portion and a projection that is attached to the upper portion that extends through a slot formed in the bracket assembly, the projection of the attachment mechanism and the slot of the bracket assembly defining a path of movement of the tablet between the first and second positions;

wherein the offset is positioned so that a portion of the offset is at a location that is higher than the first section of the upper portion of the support member and is also higher than the second section of the upper portion of the support member.

16. The chair of claim 15 wherein the bracket assembly is comprised of:

a tablet attachment portion that defines the channel that receives the portion of the upper portion of the support member and wherein the slot is formed in the tablet attachment portion of the bracket assembly; and a cap attached to the tablet attachment portion adjacent the channel and above the portion of the upper portion of the support member received within the channel.

17. The chair of claim 16 wherein the projection is attached to the upper portion of the support member via welding or an integral attachment fastening mechanism.

18. The chair of claim 16 wherein the cap has crushable ribs formed on an inner surface of the cap such that the crushable ribs engage the upper portion received in the channel.

19. The chair of claim 18 wherein the projection only supports 10-15% of the load and the rest of the load is transferred to at least one of the support member and the base via the offset when the tablet is in the second position.

20. The chair of claim 15 wherein the bracket assembly is comprised of nylon that is 50% glass filled, a polymeric material, or a plastic and wherein the projection is comprised of a metal.

21. The chair of claim 15 wherein the portion of the offset that is at the location that is higher than the first and second sections of the upper portion is a curved portion of the third section.

22. The chair of claim 15 wherein the base is comprised of a pedestal or a plurality of legs attached to the seat.

23. The chair of claim 15 further comprising a back attached to at least one of the seat and the base.

24. The chair of claim 15 wherein the seat is comprised of a polymeric material.

25. The chair of claim 15 wherein the seat is affixed to the base.

26. The chair of claim 15 wherein the seat is moveable relative to the base.

27. The chair of claim 15 wherein the tablet is moveable such that the tablet rotates about the upper portion of the support member to move from the first position to the second position.

28. The chair of claim 15 wherein the substantial amount of load that is transferred via the offset is over 50% of the load.

29. The chair of claim 15 wherein the substantial amount of load that is transferred via the offset is between 50% and 70% of the load.

30. The chair of claim 15 wherein the projection only supports 10% to 15% of the load and wherein the other 85% to 90% of the load is transferred to at least one of the support member and the base via the offset.

* * * * *